US006378990B2

(12) United States Patent
Silverbrook

(10) Patent No.: US 6,378,990 B2
(45) Date of Patent: Apr. 30, 2002

(54) NOZZLE ARRANGEMENT FOR AN INK JET PRINTHEAD INCORPORATING A LINEAR SPRING MECHANISM

(75) Inventor: Kia Silverbrook, Balmain (AU)

(73) Assignee: Silverbrook Research Pty. Ltd., Balmain (AU)

( * ) Notice: Subject to any disclaimer, the term of this patent is extended or adjusted under 35 U.S.C. 154(b) by 0 days.

(21) Appl. No.: 09/864,377

(22) Filed: May 25, 2001

Related U.S. Application Data

(63) Continuation-in-part of application No. 09/112,772, filed on Jul. 10, 1998, now Pat. No. 6,264,306.

(30) Foreign Application Priority Data

Jul. 15, 1997 (AU) ..... PO7991
Jul. 15, 1997 (AU) ..... PO8070

(51) Int. Cl.[7] ..... B41J 2/04
(52) U.S. Cl. ..... 347/54
(58) Field of Search ..... 347/54

(56) References Cited

U.S. PATENT DOCUMENTS 4,007,464 A 2/1977 Bassous et al.
4,057,807 A 11/1977 Fischbeck et al.
4,210,920 A 7/1980 Burnett et al.
6,027,205 A 2/2000 Herbert

*Primary Examiner*—John Barlow
*Assistant Examiner*—Michael S Brooke

(57) ABSTRACT

A nozzle arrangement for an ink jet printhead that is the product of an integrated circuit fabrication technique includes a substrate. An actuating mechanism is arranged on the substrate and includes an anchor member that is fast with the substrate. An effort member is displaceable with respect to the anchor member. A resiliently flexible connector is fixed between the anchor member and the effort member. The connector, the anchor member and the effort member define a linear spring so that a force applied to the effort member in a first direction relative to the anchor member results in constrained displacement of the effort member in a second direction relative to the substrate. The second direction has at least two vector components, one of which is in said first direction and another is in a third direction at right angles to said first direction with the displacement of the effort member incorporating substantially no rotational movement. An effort mechanism is arranged on the substrate and is operable on the effort member to apply force to the effort member in the first direction.

11 Claims, 4 Drawing Sheets

NOZZLE ARRANGEMENT FOR AN INK JET PRINTHEAD INCORPORATING A LINEAR SPRING MECHANISM

CROSS REFERENCED AND RELATED APPLICATIONS

This application is a continuation-in-part application of Ser. No. 09/112,772, filed, Jul. 10, 1998, now U.S. Pat. No. 6,264,306. U.S. Pat. No. 6,264,306 is hereby incorporated by reference.

FIELD OF THE INVENTION

This invention relates to a nozzle arrangement for an ink jet printhead. More particularly, this invention relates to a nozzle arrangement for an ink jet printhead, the nozzle arrangement incorporating a linear spring mechanism.

BACKGROUND OF THE INVENTION

The Applicant has invented an ink jet printhead that is capable of generating text and images at a resolution of up to 1600 dpi.

In order to achieve this, the Applicant has made extensive use of micro electro-mechanical systems technology. In particular, the Applicant has developed integrated circuit fabrication techniques suitable for the manufacture of such printheads. The Applicant has filed a large number of patent applications in this field, many of which have now been allowed.

As a result of the fabrication techniques developed by the Applicant, it has become possible for the Applicant to achieve printheads that contain up to 84000 nozzle arrangements. In most of the embodiments, each nozzle arrangement includes one or more moving components which act on ink in a nozzle chamber to eject that ink from the nozzle chamber.

Applicant has found that a particular difficulty to be overcome in such nozzle arrangements is the transformation of motion from one part of a nozzle arrangement to another part of the nozzle arrangement. The microscopic size of the components used in such nozzle arrangements provides a manufacturer with a limited degree of freedom when designing such nozzle arrangements. It follows that it is often necessary for motion that is generated in one part of the nozzle arrangement to be transferred to another part of the nozzle arrangement. In order to address this difficulty, the Applicant has conceived the idea of using a particular spring configuration to achieve the desired transformation of motion.

SUMMARY OF THE INVENTION

According to the invention, there is provided a nozzle arrangement for an ink jet printhead that is the product of an integrated circuit fabrication technique, the nozzle arrangement comprising a substrate; and an actuating mechanism that is arranged on the substrate, the actuating mechanism comprising an anchor member that is fast with the substrate;

an effort member that is displaceable with respect to the anchor member;

a resiliently flexible connector that is fixed between the anchor member and the effort member, the connector, the anchor member and the effort member defining a linear spring so that a force applied to the effort member in a first direction relative to the anchor member results in constrained displacement of the effort member in a second direction relative to the substrate, the second direction having at least two vector components, one of which is in said first direction and another is in a third direction at right angles to said first direction with the displacement of the effort member incorporating substantially no rotational movement; and an effort mechanism that is arranged on the substrate and is operable on the effort member to apply said force to the effort member in said first direction.

The invention extends to a printhead that incorporates a plurality of the nozzle arrangements.

The invention is now described, by way of example only, with reference to the accompanying drawings. The specific nature of the following description should not be construed as limiting the scope of this summary.

DETAILED DESCRIPTION OF THE DRAWINGS

Figure 1:
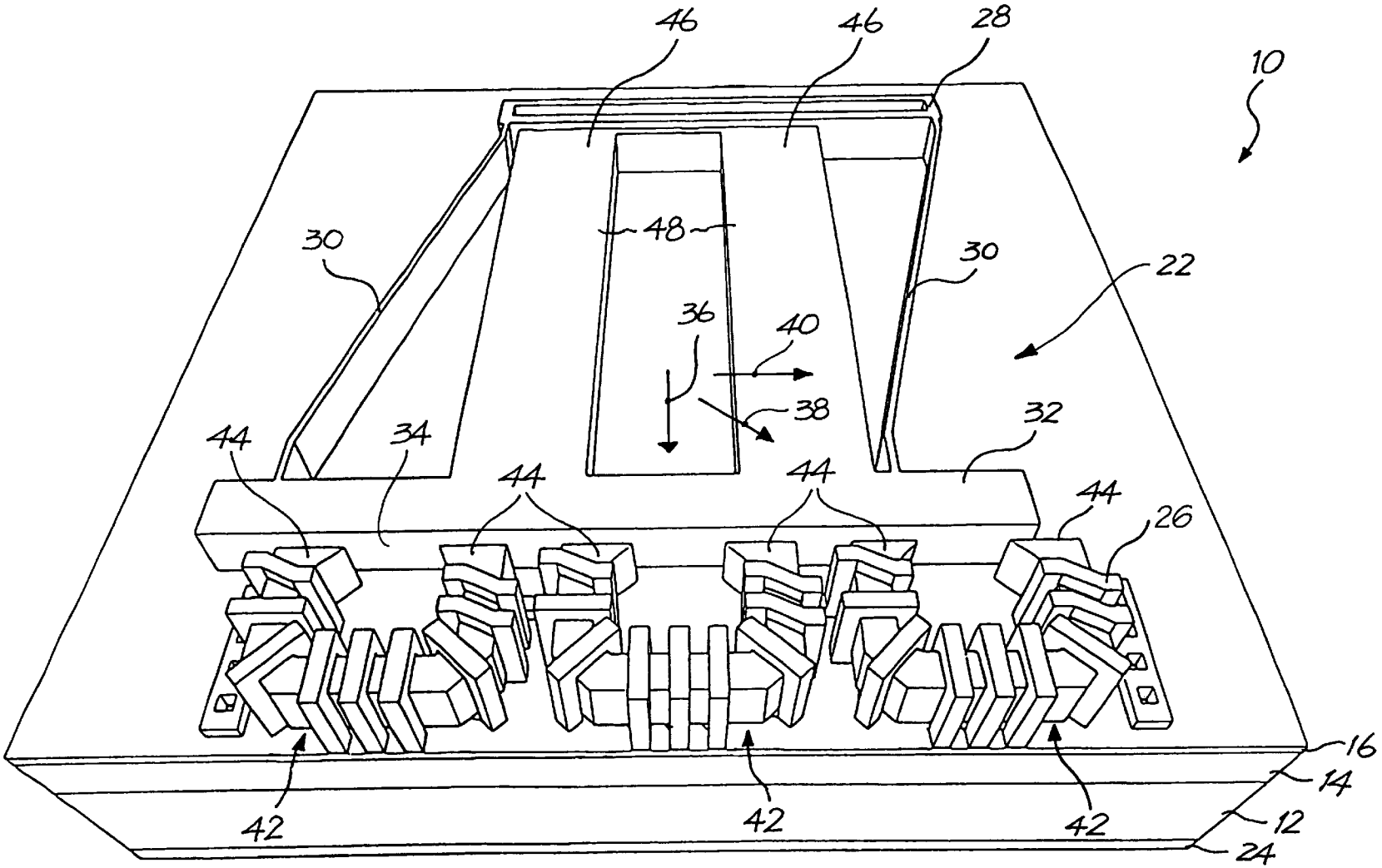
FIG. 1 shows a schematic, three dimensional view of a nozzle arrangement, in accordance with the invention, for a printhead, manufactured in accordance with an integrated circuit fabrication technique, in an inoperative condition.

In the drawings, reference numeral 10 generally indicates a nozzle arrangement, in accordance with the invention, forming part of a printhead, manufactured in accordance with an integrated circuit fabrication technique.

The nozzle arrangement 10 includes a wafer substrate 12. A drive circuitry layer 14 is positioned on one side of the wafer substrate 12 and a passivation layer 16 is positioned on the drive circuitry layer 14. The wafer substrate 12 is etched to define a nozzle chamber 18. The drive circuitry layer 14 and the passivation layer 16 are both etched to define a pair of nozzle chamber inlets 20 in fluid communication with the nozzle chamber 18. An etch stop layer 24 is positioned on an opposite side of the wafer substrate 12. An ink ejection port 26 is defined by the etch stop layer 24 and is in fluid communication with the nozzle chamber 18.

The nozzle arrangement 10 includes an actuating mechanism or actuator 22 mounted on the passivation layer 16. The actuator 22 is the result of a deposition and etching process carried out on the passivation layer 16.

The actuator 22 includes an anchor member 28 that is fast with the passivation layer 16. A pair of spaced, resiliently flexible, parallel flexure members 30 are fast with, and extend from, the anchor member 28. The actuator 22 includes an effort member 32 which is elongate and defines a face 34 that is oriented normally with respect to the passivation layer 16. The effort member 32 is connected to the flexure members 30 between ends of the flexure members 30. The flexure members 30 are configured so that, when the actuator 22 is in an inoperative condition, the flexure members 30 define acute included angles with respect to both the anchor member 28 and the effort member 32. It will thus be appreciated that if a force is applied to the effort member 32 in a first direction, indicated at 36, normal to the anchor member 28, resultant movement of the effort member 28, in a second direction 38 will have two vector components substantially at right angles to each other, one of these being in the first direction 36 and the other being in a third direction, indicated at 40. Further, the flexure members 30 serve to ensure that the effort member 32 does not undergo any rotational movement while being displaced in the second direction 38. It will be appreciated that this permits movement of the effort member 32 in the first direction 36 to be translated into movement in the third direction 40, without the introduction of any rotational motion.

The actuator 22 includes a number of electromagnets 42 that are formed on the passivation layer 16 and are positioned so that poles 44 of the electromagnets 42 are positioned adjacent the face 34 of the effort member 32. As can be seen in the drawings, the face 34 is directed in said first direction 36. The electromagnets 42 are electrically connected to the drive circuitry layer 14 so that operation of the electromagnets 42 can be controlled with a suitable control system via drive circuitry embedded in the layer 14.

The effort member 32 is of a magnetic material. Thus, upon activation of the electromagnets 42, the effort member 32 is attracted to the electromagnets 42 in the first direction 36. This results in the effort member 32 moving in the second direction 38, as described above. It will be appreciated that, by selecting suitably dimensioned flexure members 30 and by positioning the flexure members 30 in a suitable manner, different relationships between the extent of movement in the first and third directions 36, 40 can be achieved.

The anchor member 28 is positioned on one side of the ink inlets 20, with the effort member 32 positioned on an opposite side, so that the flexure members 30 extend across the inlet 20. The actuator 22 includes a pair of shutter members 46 which are attached to and extend substantially at right angles to the effort member 32. Each shutter member 46 is sufficiently large to cover each respective inlet 20.

Figure 2:
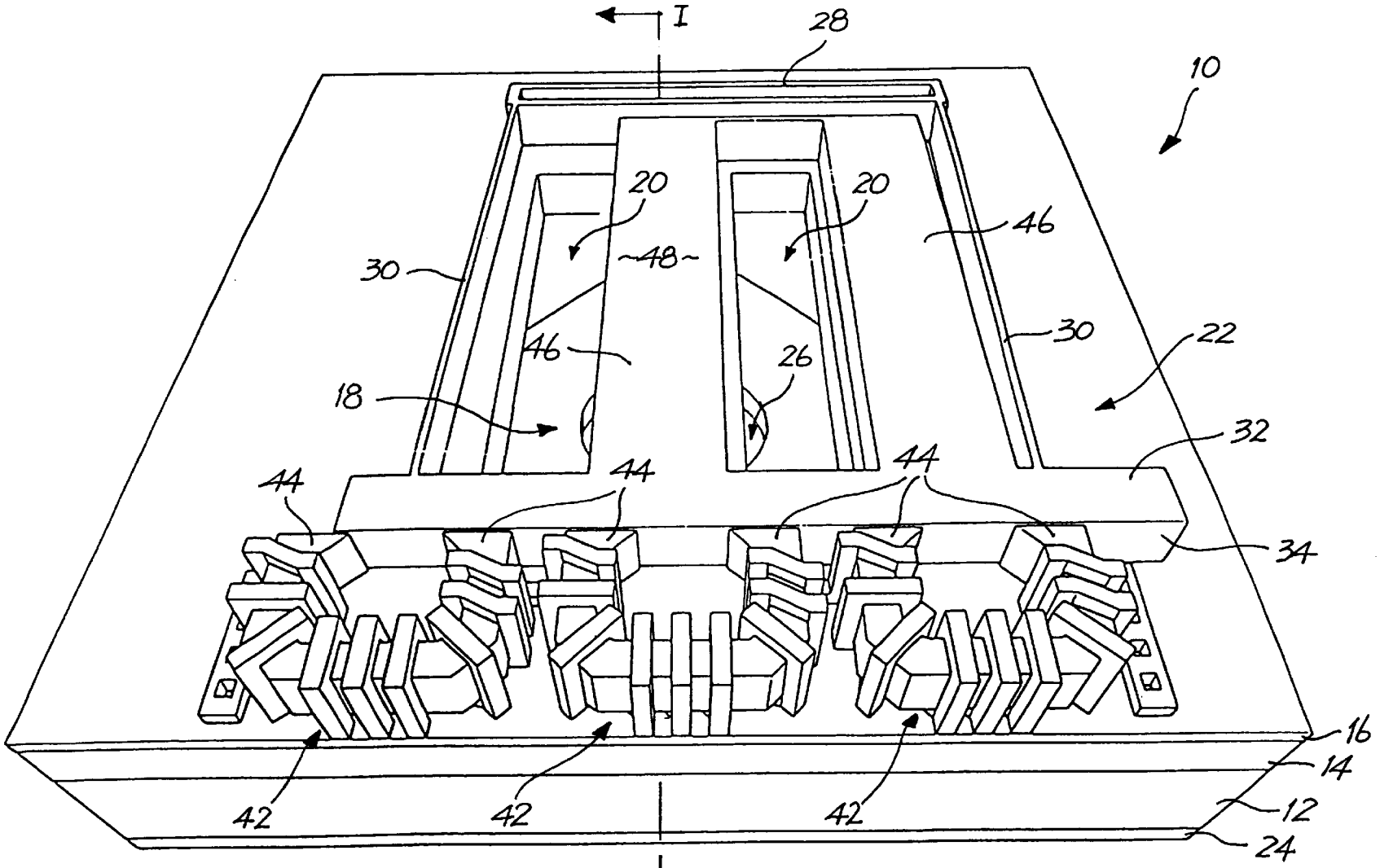
FIG. 2 shows a schematic, three dimensional view of the nozzle arrangement in an operative condition.
Figure 3:
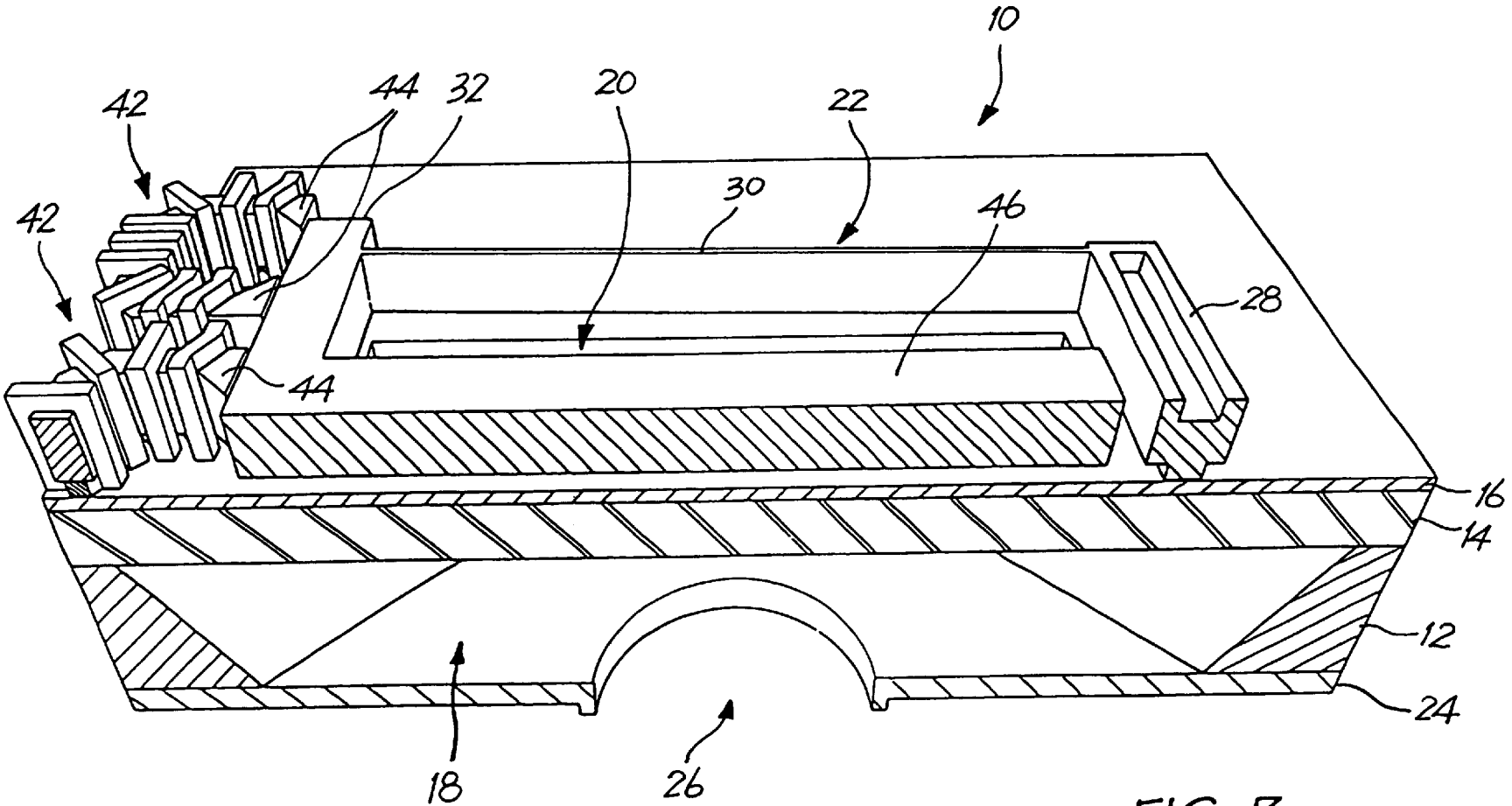
FIG. 3 shows a schematic, side sectioned view of the nozzle arrangement.
Figure 4:
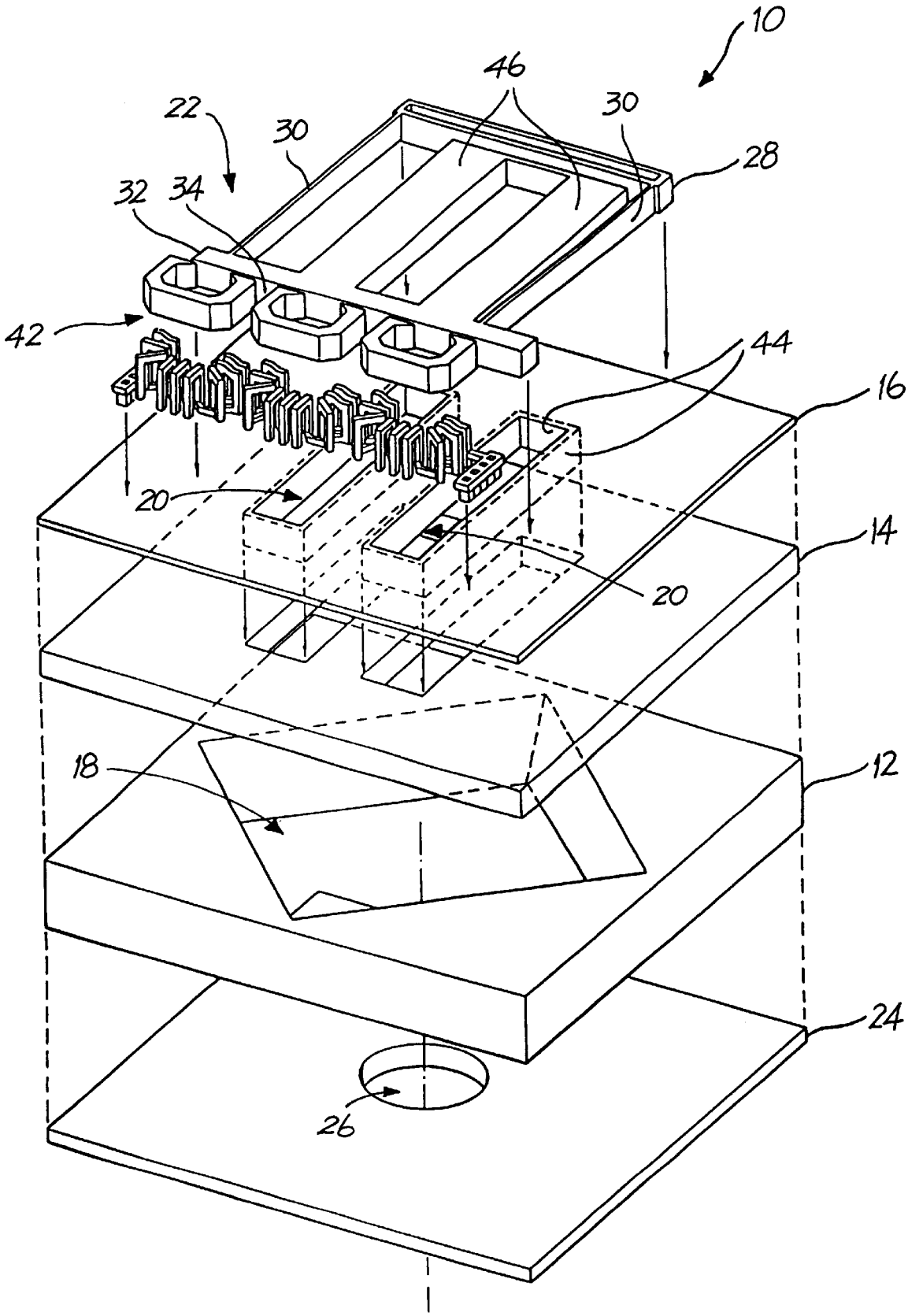
FIG. 4 shows a schematic, exploded view of the nozzle arrangement.

The effort member 32 is displaceable, under influence of the electromagnets 42 between a closed position as shown in FIG. 1 and an open position as shown in FIG. 2. As can be seen from these drawings, in the closed position, the shutter members 46 cover the inlets 20 and in the open position the shutter members 46 are displaced from the inlets 20 to permit the passage of ink into the nozzle chamber 18.

In this particular example, the actuator 22 is positioned in an ink reservoir, which is indicated at 48. Pressure is applied cyclically to the ink within the reservoir 48. This pressure is sufficient to cause the ejection of ink from the ejection port 26. Thus, by controlling the operation of the actuator 22, it is possible to achieve the selective ejection of ink from the nozzle chamber 18. Details of the operation of this particular example are provided in the above cross referenced application and will therefore not be described in this specification. Further details of the manufacture of the nozzle arrangement 10 are also provided in the cross referenced application and will also not be described in this specification.

Applicant believes that this invention provides a means whereby movement in one direction in a nozzle arrangement of the type described above can readily be translated into movement in a different direction. This can be extremely useful in such devices.

I claim:

1. A nozzle arrangement for an ink jet printhead that is the product of an integrated circuit fabrication technique, the nozzle arrangement comprising a substrate; and an actuating mechanism that is arranged on the substrate, the actuating mechanism comprising an anchor member that is fast with the substrate;

an effort member that is displaceable with respect to the anchor member;

a resiliently flexible connector that is fixed between the anchor member and the effort member, the connector, the anchor member and the effort member defining a linear spring so that a force applied to the effort member in a first direction relative to the anchor member results in constrained displacement of the effort member in a second direction relative to the substrate, the second direction having at least two vector components, one of which is in said first direction and another is in a third direction at right angles to said first direction with the displacement of the effort member incorporating substantially no rotational movement; and an effort mechanism that is arranged on the substrate and is operable on the effort member to apply said force to the effort member in said first direction.

2. A nozzle arrangement as claimed in claim 1, which includes a load member that is mounted to the effort member so that, as the effort member is displaced in said second direction the load member can perform a task which requires motion in said third direction.

3. A nozzle arrangement as claimed in claim 1, in which the substrate is in the form of a wafer substrate, the actuating mechanism being the product of an integrated circuit fabrication technique carried out on the wafer substrate.

4. A nozzle arrangement as claimed in claim 3, in which a drive circuitry layer is positioned on the wafer substrate and a passivation layer is positioned on the drive circuitry layer.

5. A nozzle arrangement as claimed in claim 4, which includes a nozzle chamber, a nozzle chamber inlet and an ink ejection port in fluid communication with the nozzle chamber, defined in the wafer substrate, the nozzle chamber inlet being in fluid communication with an ink supply.

6. A nozzle arrangement as claimed in claim 4, in which the effort mechanism is in the form of at least one electromagnet fast with the substrate and electrically connected to the drive circuitry layer, and the effort member is magnetic so that, when the, or each, electromagnet is activated, said effort member is attracted by the, or each, electromagnet.

7. A nozzle arrangement as claimed in claim 6, in which the effort member is elongate, with the effort mechanism being in the form of a number of electromagnets positioned proximate the effort member, the connector being in the form of a pair of spaced, substantially parallel, flexure arms of substantially the same length connected between the effort member and the anchor member, the flexure arms being biased into a position in which an acute included angle is defined between each flexure arm and the effort member, the electromagnets being positioned so that, when the electromagnets are activated, a force in said first direction is applied to the effort member.

8. A nozzle arrangement as claimed in claim 7, in which at least one closure member is attached to the effort member to extend from the effort member, to be displaceable between a closed and an open position in said third direction when the effort member is displaced towards and away from the electromagnets in said first direction, the, or each, closure member being dimensioned to cover the inlet when in the closed position and ink being permitted to flow through the inlet when the closure member is displaced into its open position.

9. A nozzle arrangement as claimed in claim 8, in which the closure member is in the form of at least two shutter members that extend from the effort member, the inlet being defined by at least two inlet openings that correspond with the respective shutter members.

10. A nozzle arrangement as claimed in claim 8, in which the spring is of a generally planar construction to be displaceable in a plane substantially parallel to that of the wafer substrate, when the electromagnets are activated.

11. An ink jet printhead that is the product of an integrated circuit fabrication technique, the ink jet printhead comprising a substrate; and a plurality of nozzle arrangements arranged on the substrate, each nozzle arrangement having an actuating mechanism that is arranged on the substrate, each actuating mechanism comprising an anchor member that is fast with the substrate;

an effort member that is displaceable with respect to the anchor member;

a resiliently flexible connector that is fixed between the anchor member and the effort member, the connector, the anchor member and the effort member defining a linear spring so that a force applied to the effort member in a first direction relative to the anchor member results in constrained displacement of the effort member in a second direction relative to the substrate, the second direction having at least two vector components, one of which is in said first direction and another is in a third direction at right angles to said first direction with the displacement of the effort member incorporating substantially no rotational movement; and an effort mechanism that is arranged on the substrate and is operable on the effort member to apply said force to the effort member in said first direction.

* * * * *